US005492513A

United States Patent [19]

Wang

[11] Patent Number: 5,492,513

[45] Date of Patent: Feb. 20, 1996

[54] SOLENOID TYPE DAMPING CONTROL DEVICE FOR EXERCISING MACHINES

[76] Inventor: Tao M. Wang, 6F, No. 51, Alley 22, Lane 553, Sec. 4, Chung Hsiao E. Rd., Taipei, Taiwan

[21] Appl. No.: 199,587

[22] Filed: Oct. 24, 1994

[51] Int. Cl.[6] ..... A63B 22/06; A63B 21/005

[52] U.S. Cl. ..... 482/4; 482/5; 482/51; 482/57; 482/72; 482/900; 482/903

[58] Field of Search ..... 482/1–8, 9, 51, 482/52, 54, 57, 63, 64, 70–72, 110, 114, 903, 900

[56] References Cited

U.S. PATENT DOCUMENTS 5,171,196 12/1992 Lynch ..... 482/8 X
5,267,925 12/1993 Boyd ..... 482/9 X
5,314,390 5/1994 Westing et al. ..... 482/8 X

*Primary Examiner*—Richard J. Apley
*Assistant Examiner*—Glenn E. Richman

[57] ABSTRACT

A damping control device includes a flywheel unit mounted on an exercising machine and linked to a main wheel thereof being turned by the player, a solenoid damping unit having a shoe holder mounted on a magnetic reciprocating rod and controlled by a solenoid body to press a friction shoe against the peripheral friction surface of the flywheel in producing a damping friction force, and a power control unit controlled by the setting made by the player through an exercising amount setting control and the speed signal to regulate DC power supply to the solenoid damping unit in controlling the damping force.

6 Claims, 4 Drawing Sheets

SOLENOID TYPE DAMPING CONTROL DEVICE FOR EXERCISING MACHINES

BACKGROUND OF THE INVENTION

The present invention relates to a solenoid type damping control device for exercising machines which automatically regulates the damping force to the flywheel according to the desired amount of exercise.

A variety of devices have been disclosed for use in exercising machines to produce a resistance. These devices are commonly gathered into four types, namely, the mechanical type, the hydraulic type, the power generator type, and the magnetic damping force type. The mechanical type is simple but cannot regulate the resistance automatically. The hydraulic and power generator types are expensive, therefore they are not popular. The magnetic damping force type is now popularly accepted because it does not produce noises and eliminates the action of friction. However, the magnetic damping force type will produce heat due to the intersection of lines of magnetic force causing the damping force changed. Furthermore, the magnetic damping force type is not inexpensive.

SUMMARY OF THE INVENTION

The present invention has been accomplished under the aforesaid circumstances. It is therefore an object of the present invention to provide a solenoid type damping control device for an exercising machine which can be controlled to automatically regulate the damping force according to the desired amount of exercise. It is another object of the present invention to provide a solenoid type damping control device for an exercising machine which is inexpensive to manufacture.

According to the preferred embodiment of the present invention, the solenoid type damping control device comprises a flywheel unit, a solenoid damping unit, and a power control unit. The flywheel unit comprises a flywheel having a friction surface around the periphery thereof, a driven wheel connected to the flywheel and driven by the main wheel of the exercising machine through a transmission device, such as belt, chain or gears etc. The solenoid damping unit comprises a solenoid body, a magnetic reciprocating rod inserted through the solenoid body, a soft iron disk fastened to one end of the magnetic reciprocating rod, a shoe holder having a rear end fastened to an opposite end of the magnetic reciprocating rod by a pivot pin, a friction shoe fastened to the shoe holder and fitting over the friction surface of the flywheel, a spring mounted around the magnetic reciprocating rod and retained between the shoe holder and the solenoid body to support the shoe holder permitting the friction shoe to be retained the shoe surface in completely contact with the friction surface of the flywheel. The power control unit is controlled to regulate DC power supply to the solenoid damping unit in providing a damping friction force to the flywheel unit, comprising an adapter to convert city power supply to low voltage DC Dower supply, an IC board connected to the adapter to control the operation of the solenoid damping unit, an exercising amount setting control having an input end for setting the damping force according to the desired amount of exercise and an output end connected to the IC board, a speed detector controlled by the IC board to detect the revolving speed of the main wheel and to provide a detected signal to the IC board causing it to regulate DC power supply to the solenoid damping unit.

DETAILED DESCRIPTION OF THE PREFERRED EMBODIMENT

Figure 1:
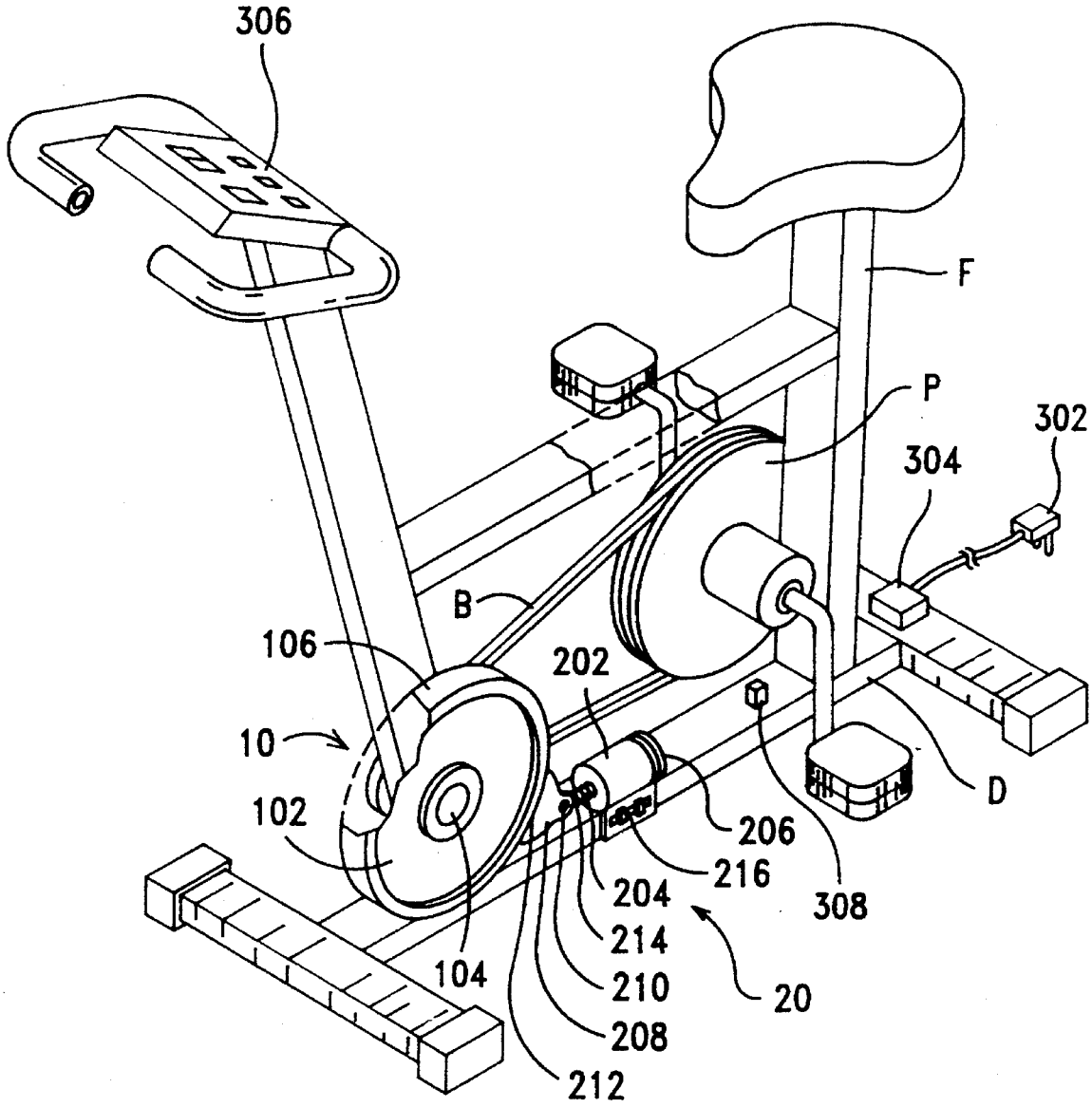
FIG. 1 is an elevational view showing the preferred embodiment of the solenoid type damping control device of the present invention mounted on an exercising machine.
Figure 2:
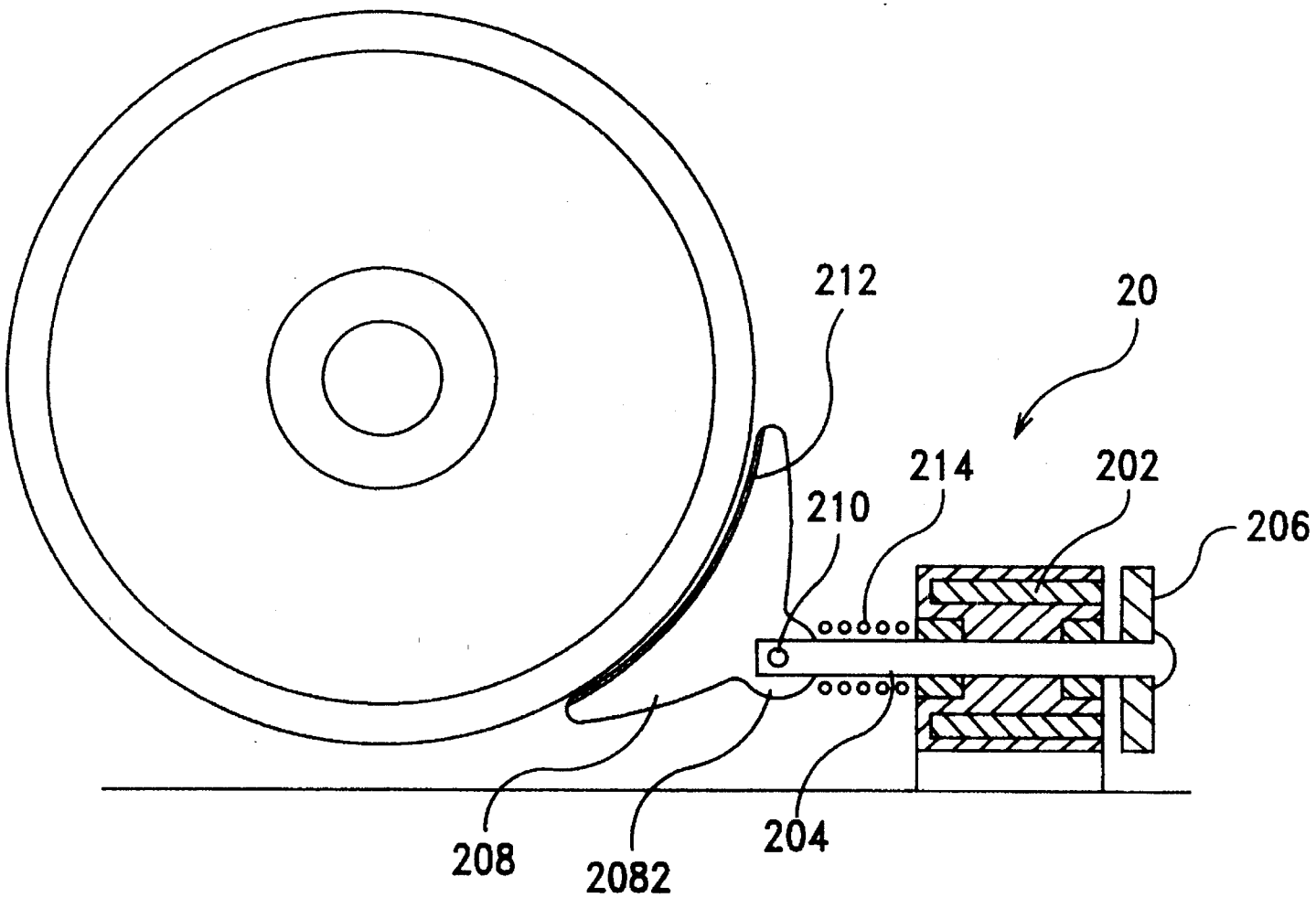
FIG. 2 is a side plain view of the solenoid damping unit of the solenoid type damping control device of the preferred embodiment of the present invention.
Figure 3:
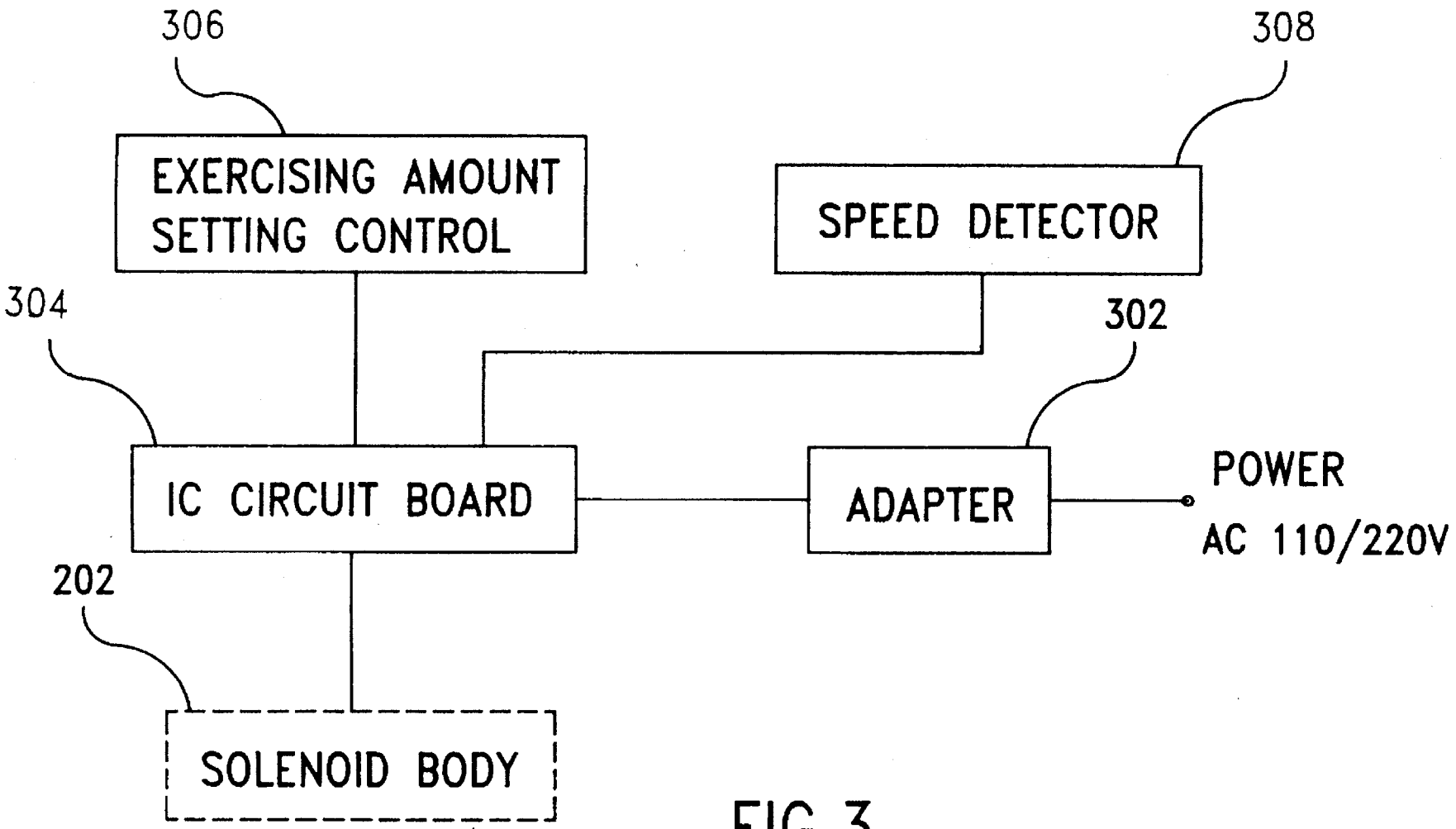
FIG. 3 is a block diagram of the power control unit of the solenoid type damping control device of the preferred embodiment of the present invention.

Referring to FIGS. 1, 2, and 3, in which reference number 10 indicates a flywheel unit; reference number 102 indicates a flywheel driven by a belt wheel (or chain wheel or gear) P through a belt (or chain or gear) B; reference number 104 indicates the wheel axle of the flywheel 102 mounted on an upright frame F of the exercising machine; reference number 106 indicates the peripheral friction surface of the flywheel 102 which is precisely finished; reference number 30 indicates a power control unit; reference 302 indicates a power adapter which converts AC city power supply to a low voltage DC power supply; reference number 304 indicates an IC board mounted on the upright frame F and connected to the adapter 302 to control the operation of the whole system; reference number 306 indicates an exercising amount setting control mounted on the upright frame F in the front for setting the damping force according to the desired amount of exercise (the output end of the exercising amount setting control is connected to the IC board 304); reference number 308 indicates a speed detector mounted on the upright frame F at a suitable location to detect the revolving speed of the main wheel P (the output end of the speed detector is connected to the IC board 304); reference number 20 indicates solenoid damping unit mounted on the base frame D of the exercising machine near the flywheel 102; reference number 202 indicates a solenoid body; reference number 204 indicates a magnetic reciprocating rod inserted through the solenoid body 202; reference number 206 indicates a soft iron disk fastened to the rear end of the magnetic reciprocating rod; reference number 208 indicates a shoe holder having a rear end 2082 fastened to the front end of the magnetic reciprocating rod 204 by a pivot pin 210; reference number 212 indicates a friction shoe fastened to the shoe holder 208 and fitting over the friction surface 106 of the flywheel 102; reference number 214 indicates a spring mounted around the magnetic reciprocating rod 204 and retained between the shoe holder 208 and the solenoid body 202 to support the shoe holder 208 permitting the friction shoe 212 to be retained in contact with the friction surface 106 of the flywheel 102; reference number 216 indicates an elongated mounting slot on the solenoid body 202 fastened to the base frame D of the exercising machine by screws (the elongated mounting slot 216 allows the gap between the friction shoe 212 and the friction surface 106 of the flywheel 102 to be adjusted)

When the adapter 302 is connected to city power supply, set signal from the exercising amount setting control 306 and speed signal from the speed detector 308 are respectively inputted to the IC board 304 causing it to regulate DC voltage being sent to the solenoid body 202, so as to adjust the magnetic attraction force of the soft iron disk 206, and therefore the friction shoe 212 is controlled to give a proper friction resistance to the flywheel 102.

Figure 4B:
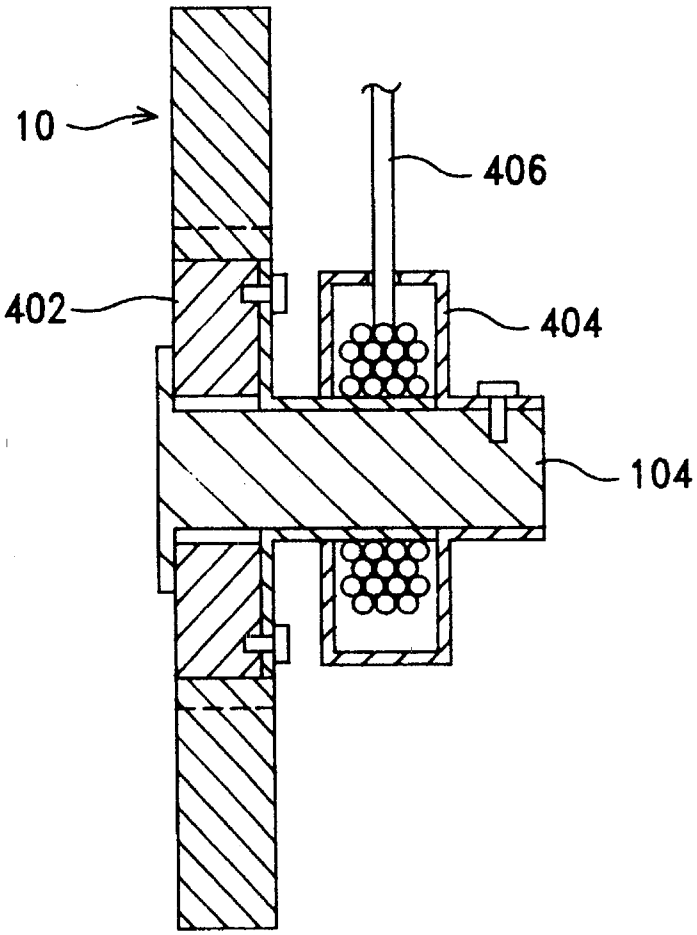
FIG. 4B is a cross sectional view taken on line A—A of FIG. 4A.
Figure 4A:
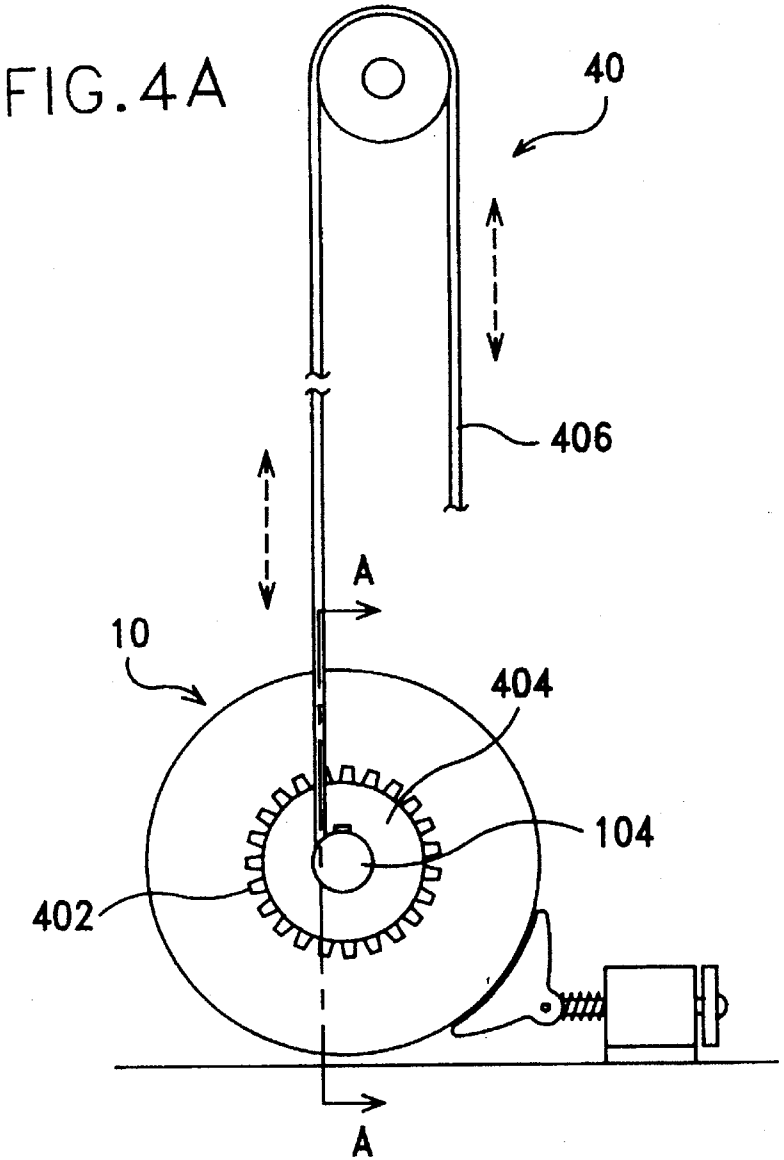
FIG. 4A shows an application of the present invention in a reciprocating exercise.

Referring to FIGS. 4A and 4B, the present invention may be used in a reciprocating type exercising machine 40 in which an one-way free wheel 402 is mounted around the wheel axle 104 of the flywheel 102; a cable rewinder box 404 mounted on the wheel axle 104 to take up a cable 406. When the cable 406 is pulled by the player, the one-way free wheel 402 is driven to turn the flywheel 10; when the player releases the cable 406, the cable rewinder box 404 automatically takes up the cable 406.

While only one embodiment of the present invention has been shown and described, it will be understood that various modifications and changes could be made without departing from the spirit and scope of the invention.

What is claimed is:

1. A solenoid type damping control device comprising:

a flywheel unit mounted on the upright frame of an exercising machine, said flywheel unit comprising a flywheel having a friction surface around the periphery thereof, a driven wheel connected to said flywheel and driven by the main wheel of the exercising machine through a transmission device;

a solenoid damping unit mounted on the base frame of the exercising unit and controlled to give a damping friction force to said flywheel, said solenoid damping unit comprising a solenoid body having a mounting plate fastened to the base frame of the exerciser, a magnetic reciprocating rod inserted through a hole on said solenoid body, a soft iron disk fastened to one end of said magnetic reciprocating rod, a shoe holder having a rear end fastened to an opposite end of said magnetic reciprocating rod by a pivot pin, a friction shoe fastened to said shoe holder and fitting over said friction surface of said flywheel, a spring mounted around said magnetic reciprocating rod and retained between said shoe holder and said solenoid body; and a power control unit controlled to regulate DC power supply to said solenoid damping unit in providing a damping friction force to said flywheel unit, said power control unit comprising an adapter to convert city power supply to low voltage DC power supply, an IC board connected to said adapter to control the operation of said solenoid damping unit, an exercising amount setting control having an input end for setting the damping force according to the desired amount of exercise and an output end connected to said IC board, a speed detector controlled by said IC board to detect the revolving speed of the main wheel and to provide a detected signal to said IC board causing it to regulate DC power supply to said solenoid damping unit.

2. The solenoid type damping control device of claim 1 wherein said soft iron disk is disposed outside said solenoid body and reciprocated relative to said solenoid body, the outer diameter of said soft iron disk being approximately equal to that of said solenoid body.

3. The solenoid type damping control device of claim 1 wherein said shoe holder can be turned about said pivot pin.

4. The solenoid type damping control device of claim 1 wherein said spring of said solenoid damping unit is mounted around said magnetic reciprocating rod and retained between said shoe holder and said solenoid body to support said shoe holder permitting said friction shoe to be retained the shoe surface in completely contact with said friction surface of said flywheel.

5. The solenoid type damping control device of claim 1 wherein said solenoid body of said solenoid damping control unit produces a magnetic attraction force to attract said soft iron disk, according to the voltage being regulated by said IC board within 0–24 V, causing said magnetic reciprocating rod moved to force said friction shoe produce a damping resistance to said flywheel.

6. The solenoid type damping control device of claim 1 wherein said flywheel unit further comprises an one-way free wheel mounted on a center wheel axle on said flywheel at an outer side, a cable rewinder box mounted on the center wheel axle of said flywheel to automatically take up a cable after being pulled.

* * * * *